US009956809B2

(12) United States Patent
Young et al.

(10) Patent No.: US 9,956,809 B2
(45) Date of Patent: May 1, 2018

(54) STAIR STEP PORTFOLIO FILE WITH FRONT POCKET AND METHOD FOR MANUFACTURING SAME

(71) Applicant: Smead Manufacturing Company, Hastings, MN (US)

(72) Inventors: Glenda Young, Beldenville, WI (US); Daniel Seleski, Hastings, MN (US)

(73) Assignee: Smead Manufacturing Company, Hastings, MN (US)

( * ) Notice: Subject to any disclaimer, the term of this patent is extended or adjusted under 35 U.S.C. 154(b) by 0 days. days.

(21) Appl. No.: 15/335,758

(22) Filed: Oct. 27, 2016

(65) Prior Publication Data

US 2017/0120666 A1 May 4, 2017

Related U.S. Application Data

(60) Provisional application No. 62/249,132, filed on Oct. 30, 2015.

(51) Int. Cl.
*B65D 27/00* (2006.01)
*B42F 7/08* (2006.01)

(52) U.S. Cl.
CPC ..... *B42F 7/08* (2013.01)

(58) Field of Classification Search
CPC ..... B42F 7/08
USPC ..... 229/67.1–67.4
See application file for complete search history.

(56) References Cited

U.S. PATENT DOCUMENTS

| | | | | | |
|---|---|---|---|---|---|
| 1,346,298 | A * | 7/1920 | Congdon | B42F 7/06 | 229/67.1 |
| 2,188,730 | A * | 1/1940 | Swab | B65D 5/0005 | 229/67.3 |
| 2,460,909 | A * | 2/1949 | Shaffer | B42F 7/00 | 229/117.05 |
| 4,589,544 | A * | 5/1986 | Schweinsberg | B42F 7/06 | 206/308.3 |
| 5,398,866 | A * | 3/1995 | Bluemle | B65D 5/3685 | 229/117.01 |
| 5,545,087 | A * | 8/1996 | Seward | B42F 15/04 | 229/67.1 |
| 5,741,028 | A * | 4/1998 | Hatano | A45C 13/02 | 229/67.1 |
| 6,607,122 | B1 * | 8/2003 | Ong | B42F 7/08 | 150/113 |
| 8,425,387 | B1 | 4/2013 | Christensen et al. | | |
| 8,540,138 | B1 | 9/2013 | Christensen et al. | | |
| 2009/0039143 | A1 * | 2/2009 | Huang | A45C 3/02 | 229/67.4 |

* cited by examiner

*Primary Examiner* — Jes F Pascua
(74) *Attorney, Agent, or Firm* — Altera Law Group, LLC

(57) ABSTRACT

An add-on pocket affixable to a folder or a stair-step, expandable file folder or other product with a front face is disclosed. The add-on pocket has a portion which is affixed to the front on the folder and a flap portion which wraps over the front. The remainder of the pocket is formed from a bottom portion and front portion which includes retaining tabs. The tabs mate to form the sidewalls of the pocket.

11 Claims, 13 Drawing Sheets

STAIR STEP PORTFOLIO FILE WITH FRONT POCKET AND METHOD FOR MANUFACTURING SAME

CROSS-REFERENCE TO RELATED APPLICATION

This application claims priority and incorporates by reference in their entirely the disclosure of U.S. provisional patent application No. 62/249,132 filed 30 Oct. 2015.

This application incorporates: U.S. Pat. No. 8,425,387 issued 23 Apr. 2013 to Christensen et al., U.S. Pat. No. 8,540,138 and patent application Ser. No. 14/709,975 filed 12 May 2015 to Young and Seleski by reference in their entirely.

BACKGROUND OF THE INVENTION

Field of the Invention

The present invention is directed to file folders, and more particularly to stair-step style expandable file folders.

Description of the Related Art

File folders are common in home and office settings.

A typical expandable file folder includes a series of rectangular dividers that are joined on three sides to respective pleats in an expandable gusset. The folder has pockets formed between each adjacent pair of dividers. Each pocket is accessible from the unbound edge of the dividers, which will be referred to in this document as the top edge of the file folder.

One common type of expandable file folder is referred to as a stair-step expandable folder. In a stair-step expandable folder, the dividers extend by different amounts along the top edge of the folder. The dividers at the back of the folder extend upward farther than those at the front of the folder, so that the top edges of all the dividers are viewable simultaneously. A user can select a desired pocket directly, rather than having to flip through all the dividers to find the correct pocket.

One potential drawback to typical stair-step expandable folders is that the pockets have different depths. Because the dividers at the rear of the folder extend farther upward than those at the front of the folder, the pockets at the rear of the folder are deeper than those at the front of the folder. As a result, documents stored in a rear pocket are more difficult to access than those stored in a front pocket. This difficulty in accessing the rear pockets is unacceptable.

Accordingly, there exists a need for a stair-step expandable file folder in which the stored documents are easily accessible for all pockets, and a suitable method for manufacturing such a folder.

In U.S. Pat. No. 8,425,387 a stair step file is disclosed. In this disclosure, we have invented structures and methods for simplification of the product and manufacture.

BRIEF SUMMARY OF THE INVENTION

The following summary is intended to help the reader understand the entire patent application and is not intended as a limitation on the scope of invention.

There is disclosed, amongst other things, a stair-step file folder having a plurality of top-accessible pockets, having a box frame having a bottom, left and right sidewalls and a front and back wall, said sidewalls having a plurality of vertically oriented accordion folds to allow expansion of the frame, a unitary divider web insert configured to create a plurality of top accessible pockets of substantially equal depth having:

a. a continuous web of material folded to form a first panel attachable to said back wall, b. a second panel joined to said first panel at their bottom edges by a plurality of accordion folds having an apex and valleys on either side said apex thereby joining said first and second panels and providing expandability therebetween;

c. a third panel joined to said second panel at their bottom edges by a plurality of accordion folds having an apex and valleys on either side said apex thereby joining said second and third panels and providing expandability therebetween;

d. a fourth panel affixable to said front wall and also joined to said third panel at their bottom edges by a plurality of accordion folds having an apex and valleys on either side said apex thereby joining said third and fourth panels and providing expandability therebetween;

e. at least one of said panels including left and right flanges attachable to said accordion folds in said sidewalls, to maintain a fixed height of said pockets.

It is understood that this 4 pocket version is only exemplary. The box file could have more or less pockets built in a similar way.

Also disclosed is a folder wherein said flanges are attached to said sidewalls at a location which maintains said valleys generally coplanar and generally horizontal. By making the valleys coplanar the bottom of the pocket is uniform in depth.

Also disclosed is a folder wherein said flanges are lateral extensions from said panel and wherein said flanges are adhered to said accordion folds.

Also disclosed is a folder wherein each of said panels is sized to define a depth of pocket generally equal to other pockets.

Also disclosed is a folder wherein a final pocket is defined between said front wall and said fourth panel and wherein the bottom of said final pocket is the bottom of the frame.

Also disclosed is a folder wherein a first pocket is defined between said first and second panels and wherein said accordion folds constitute the floor thereof.

Also disclosed is a folder wherein a second pocket is defined between said second and third panels and wherein said accordion folds constitute the floor thereof.

Also disclosed is a folder wherein a third pocket is defined between said third and fourth panels and wherein said accordion folds constitute the floor thereof.

Also disclosed is a folder wherein said floors of successive pockets from first to third are successively vertically higher.

Also disclosed is a folder wherein said web insert includes a plurality of panels joined end to end to form a web.

Also disclosed is a stair-step file folder having a plurality of top-accessible pockets, has a box frame having a bottom, left and right sidewalls and a front and back wall; said sidewalls having a plurality of vertically oriented accordion folds to allow expansion of the frame; a unitary insert divider web configured create a plurality of top accessible pockets of substantially equal depth comprising:

a. a continuous web of material folded to form a first panel attachable to said back wall, b. a second panel joined to said first panel at their bottom edges by a fold therebetween;

c. a third panel joined to said second panel at their bottom edges by a fold therebetween;

d. a fourth panel affixable to said front wall and also joined to said third panel at their bottom edges by a fold therebetween;

e. at least one of said panels including left and right flanges attachable to said accordion folds in said sidewalls, to maintain a fixed height of said pockets.

Also disclosed is a method for constructing a stair-step file folder, having a box frame with zig zag gusset sloping sidewalls and front and back inner walls, the method including any or all of the following steps in any order:

cutting and folding a blank of material to create a unitary web insert dividers, having:

a first, second, third and fourth panels joined panels, each plane joined to the next by folding accordion folds therebetween to form bottoms of pockets, cutting said blank to create lateral flange extensions on said third and fourth panels;

affixing said flange extensions to said gusset sidewalls;

affixing said first and fourth panels to said front and back inner walls, said flange extensions and panels being affixed so that panels form a plurality of pockets of having bottoms being vertically progressively higher from front to back.

Also disclosed is a method of constructing a divider insert for a folder box as described above.

A further embodiment adds an additional pocket in front of the existing stair step folder. This pocket can be made integral to the previous embodiments or as an add-on or as a separate pocket to any folder. In this embodiment the front panel of the folder is used as part of a cantilevered structure to secure the pocket thereto.

In one embodiment, there is disclosed a frontal pocket for a stair-step file folder, the file folder having a plurality of top-accessible pockets, having a box frame having a bottom, left and right sidewalls and a front and back wall and a front-most panel having a top edge and interior and exterior faces; a frontal pocket having any or all of the following:

a planar blank having a plurality of score lines and folds thereby creating an insert pocket unit including;

a first portion extending downwardly and being affixed onto at least a portion of said interior face of said front-most panel and being folded over said top edge and extending downwardly and being affixed to said exterior face, to form one sidewall of the frontal pocket; said first portion having lateral edges on the portion affixed to said exterial face, and first retainer flaps extending from said lateral edges;

a second portion extending lateral and outwardly from said exterior face a predetermined distance to form the bottom of the frontal pocket;

a third generally vertical portion extending generally upward line from said second portion and generally parallel and spaced apart from said first portion to form a second sidewall of the frontal pocket, said third portion having lateral edges and second retainer flaps extending therefrom, said first and second retainer flaps being located to, when bent toward each other, overlap, therefore forming sidewalls of said frontal pocket.

There is also disclosed a frontal pocket wherein said second portion includes a central longitudinal score line so that it can have an accordion fold.

There is also disclosed a frontal pocket wherein said first portion is glued to said inner and outer faces forming a structural liner for the frontal pocket.

There is also disclosed a frontal pocket wherein said first portion is removably affixed to said inner and outer faces so that that the frontal pocket is removable from the folder.

There is also disclosed a frontal pocket wherein said third portion is less than 60% as tall as the height of the exterior face. Other percentages are possible, generally, 35, 40, 45, 50, 55, 60, 65, 70, 75, 80, 85, 90, 95 and 100%, and all percentages in between.

There is also disclosed a frontal pocket wherein said first portion being sized to overlay onto said interior face and having a lateral width not greater than the lateral width of the interior face.

There is also disclosed a frontal pocket wherein said second portion includes lateral edges and wherein said frontal pocket includes a pair of upwardly extending closure flaps extending from said lateral ends and configured to seal gaps between the first, second and third portions at the bottom.

There is also disclosed a frontal pocket wherein said retainer flaps overlie one another and are bonded together to form sidewalls.

There is also disclosed a frontal pocket for any kind of pocket folder or planar surface having a front-most panel, itself having a top edge and interior and exterior faces, the pocket having any or all of the following:

a planar blank having a plurality of score lines and folds thereby creating an insert pocket unit including;

a first portion extending downwardly and being affixed onto at least a portion of said interior face of said front-most panel and being folded over said top edge and extending downwardly and being affixed to said exterior face, to form one sidewall of the frontal pocket; said first portion having lateral edges on the portion affixed to said exterial face, and first retainer flaps extending from said lateral edges;

a second portion extending lateral and outwardly from said exterior face a predetermined distance to form the bottom of the frontal pocket;

a third generally vertical portion extending generally upward line from said second portion and generally parallel and spaced apart from said first portion to form a second sidewall of the frontal pocket, said third portion having lateral edges and second retainer flaps extending therefrom.

There is also disclosed a method of making a front-most pocket for a file folder, where the file folder has a front panel having a top edge and interior and exterior faces of predefined length and width;

a frontal pocket being formed by any or all of the steps of:

cutting a planar blank web material to have first, second and third collinear segment portions with scored fold lines between the portions; the first portion being cut to be no wider than the width of the interior face and no longer than the length of the interior face;

cutting the blank have retaining extensions extending laterally from said first and second portions;

cutting the blank to have closure flaps extending from lateral edges of said first and their portions, the closure flaps being cut to overlie each other when said first and third portions are folded parallel to each other, said closure flaps thereby forming sidewalls of the pocket;

adhering the first portion to said exterior face and folding a part of said first portion over said interior face and adhering it thereto, thereby creating a cantilevered attachment between the folder and the pocket;

a planar blank having a plurality of score lines and folds thereby creating an insert pocket unit including;

a first portion extending downwardly and being affixed onto at least a portion of said interior face of said front-most panel and being folded over said top edge and extending downwardly and being affixed to said exterior face, to form one sidewall of the frontal pocket; said first portion having lateral edges on the portion affixed to said exterial face, and first retainer flaps extending from said lateral edges;

a second portion extending lateral and outwardly from said exterior face a predetermined distance to form the bottom of the frontal pocket;

a third generally vertical portion extending generally upward line from said second portion and generally parallel and spaced apart from said first portion to form a second sidewall of the frontal pocket, said third portion having lateral edges and second retainer flaps extending therefrom, said first and second retainer flaps being located to, when bent toward each other, overlap, therefore forming sidewalls of said frontal pocket.

DETAILED DESCRIPTION OF THE INVENTION

A stair-step, expandable file folder is disclosed, in which each pocket in the folder has a pre-determinable depth, preferably the same depth, rather than the back pockets being automatically deeper than the front pockets. The folder preferably includes a unitary (single piece) divider insert that forms the front and back sides of the pockets of the folder except for the first and last pocket wall. In the alternative, the divider insert can be made of a series of end to end connected elements. The divider when folded creates pockets of decreasing depth going from front to back in order that the height of the pocket bottom is increasing front to back to that article (most often papers in backmost pockets will still be visible because top to bottom depth of the pockets remain generally equal).

It is however possible to utilize this invention to have pockets of different depth depending upon need. For example, it is possible that some pockets could be suitable for A-4 or letter size depth in landscape (horizontal) orientation while others could be in letter (vertical) orientation. Likewise, other paper formats could be accommodated by setting different predetermined depths for different pockets.

In our previous invention found in U.S. Pat. No. 8,425,387, we provided separate dividers for each pocket. In this invention, we have modified the structure to improve it in many ways including simplification in its manufacture and assembly.

The divider is folded to form a plurality of bottoms of the pockets, with the folded portions also increasing in height from the front to the back of the folder. The unitary (meaning either a single web or a series of webs joined together end to end to form a single web) divider extends downward to form the back face of a pocket, is folded forward to form the bottom face of the pocket, and is folded upwardly again to form a wall of the next pocket, and so on. To maintain the divider in its position suspended above the bottom of its box/frame container (forming surrounding walls, at least one of the divider sections includes bendable flanges which can be mounted), such as by adhesive on the inside wall of the box at a predetermined height above the box floor. This creates the stair step "stadium" style ascending pocket height so that items in the pockets are equally visible in upper as well as lower pockets.

The preceding paragraphs are merely a summary, and should not be construed as limiting in any way. A more detailed description follows, first of the folder itself in figures and the accompanying text, then of the method of manufacturing such a folder.

Figure 1:
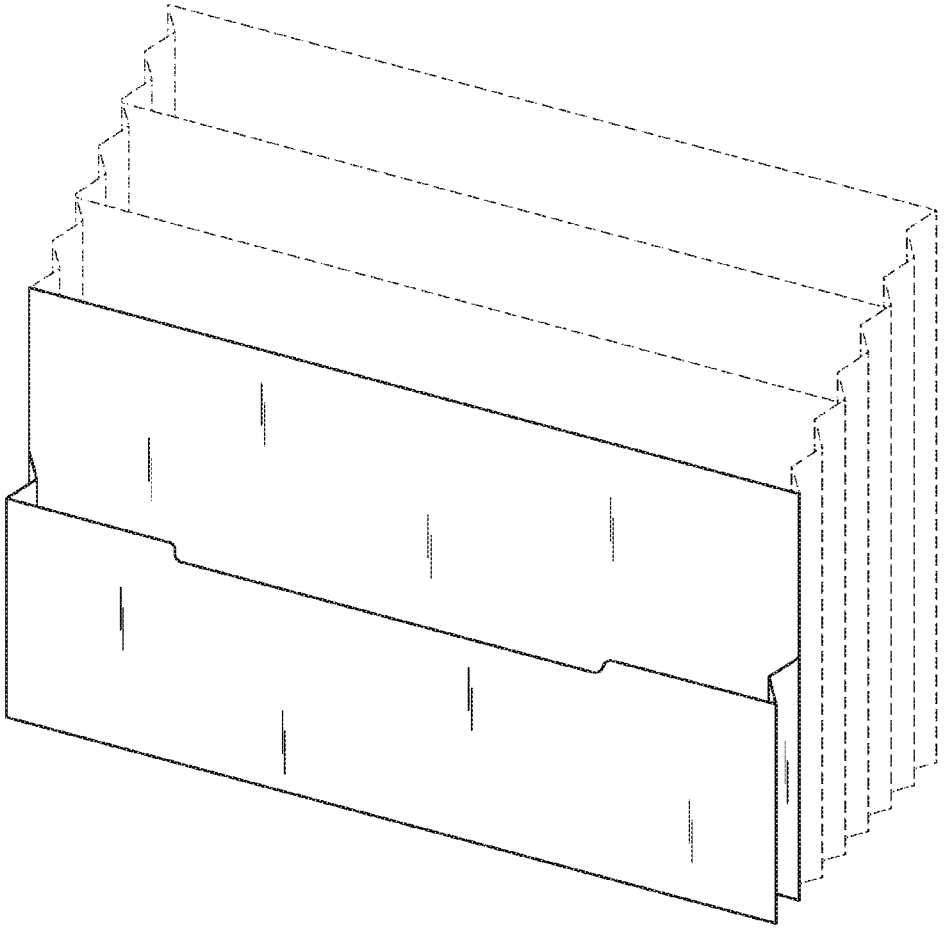
FIG. 1 is perspective view of an expandable stair-step folder.

FIG. 1 is a perspective view of a stair step or stadium portfolio file 10. It has a front face 12, a rear or back face 14, left and right symmetric sidewalls 18 which are materials stretchable to accommodate filling of the defined space, a bottom 20 and an open top 22. This defines an accordion box frame with sidewalls that slope downwardly toward the front and with space inside. Of course, it is understood that the front pocket may be attached to anything with a front wall, such as a simple folder, so the words "box frame" are intended to include such alternative structures.

In this embodiment there are three pockets 30, 32, and 34 defined by a unitary web divider (unitary has been defined above), 40 with panels 40*a*, 40*b* visible in this view.

Figure 2:
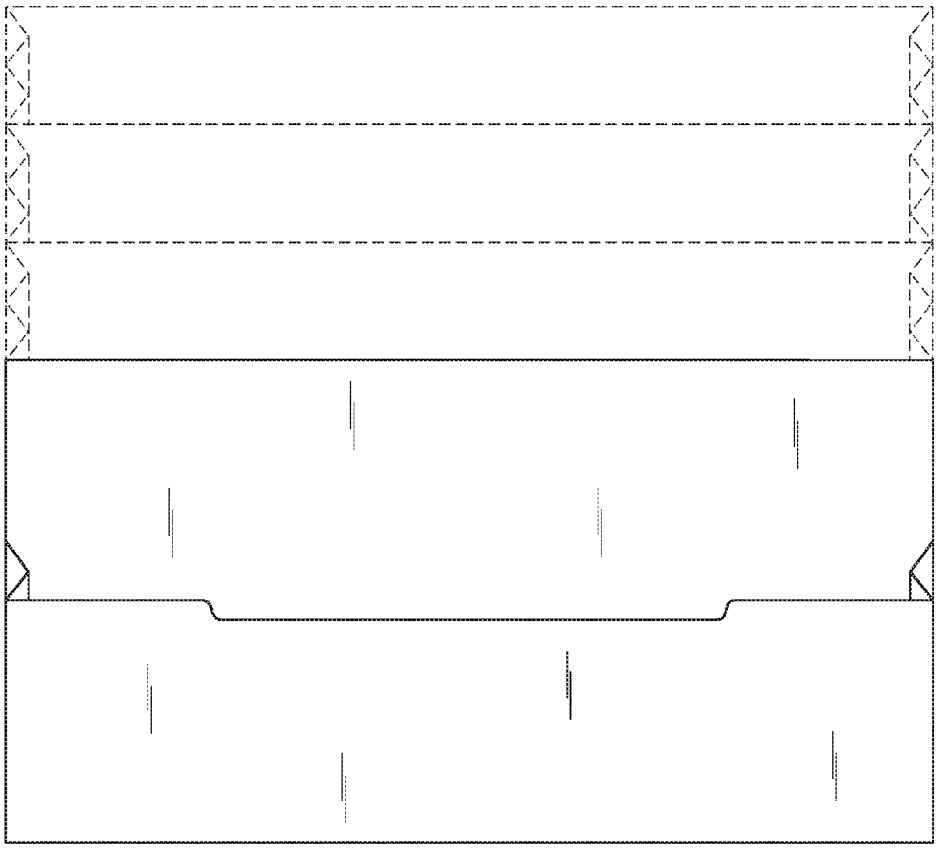
FIG. 2 is a side view of the subject matter of FIG. 1 with broken lines to illustrate steps within the interior.

FIG. 2 illustrates as side view the bottom of the divider 40 shown in phantom. Notice that it is a stair step. In phantom lines, many more steps are shown that are actually illustrated in FIG. 1, so as to make clear that there can be many more pockets.

Figure 6:
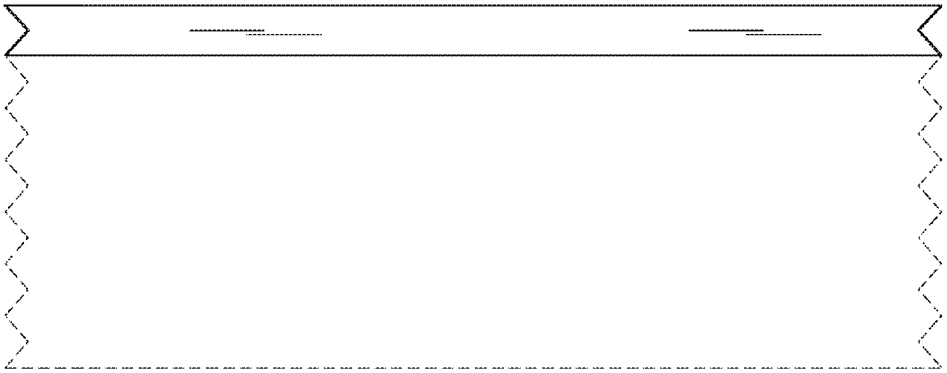
FIG. 6 is a view of the insert separator of FIG. 3 folded flat.

FIG. 6 shows the accordion fold side and bottom walls which have a plurality of folds which form an expanding gusset typically of paper or Tyvek®.

Figure 7:
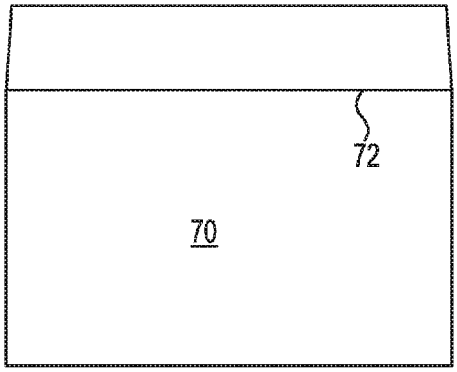
FIG. 7 is a front plan view of the overwrap front panel.
Figure 8:
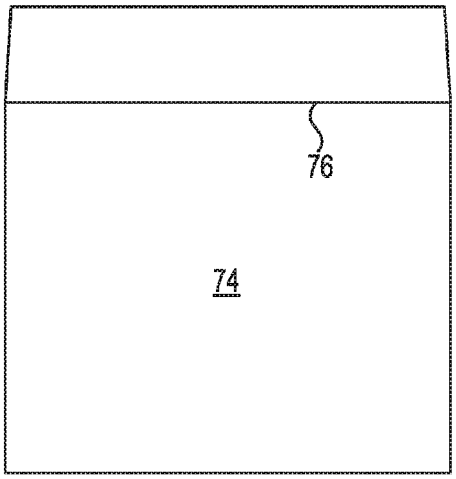
FIG. 8 is a rear plan view of the overwrap back panel.
Figure 9:
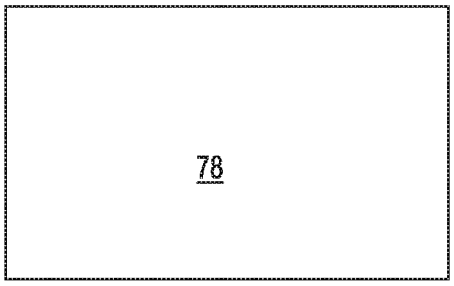
FIG. 9 is a front plan view of the front panel.
Figure 10:
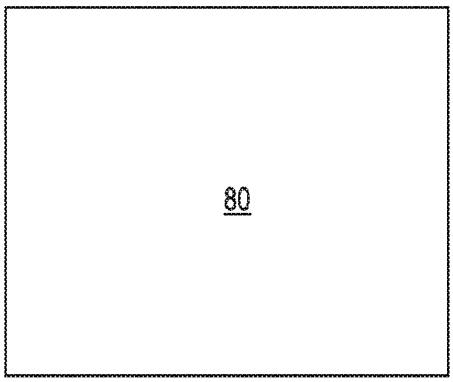
FIG. 10 is a front plan view of the back panel.

FIGS. 7, 8, 9, 10 represent optional cover sheets which can be applied over various walls of the box. FIG. 7 illustrates a front cover 70 with a fold 71. The lower portion is applied to the box as shown in FIG. 1 and the smaller portion is folded into the inside. FIG. 8 is a back cover panel 74 with a like fold 74. It is applied to the back side with the fold over flap folded into the box and affixed. FIGS. 9 and 10 are interior cover sheets 78, 80 which applied to the interior of the box over flaps to provide a seamless appearance.

Figure 3:
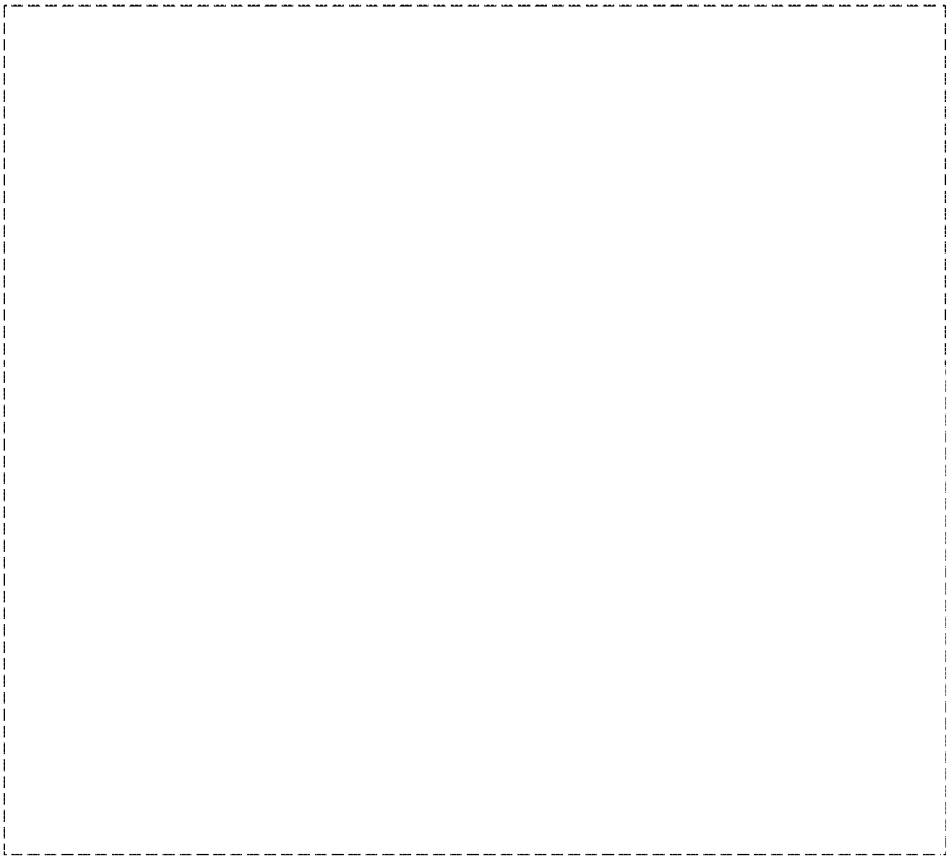
FIG. 3 is a side perspective view of FIG. 1 with the interior separator removed.
Figure 4:
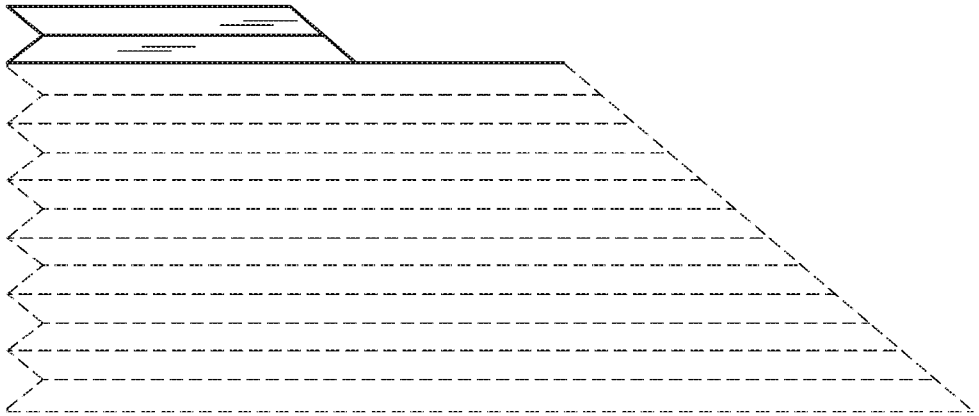
FIG. 4 is a view like FIG. 3 with the separator partly removed.
Figure 5:
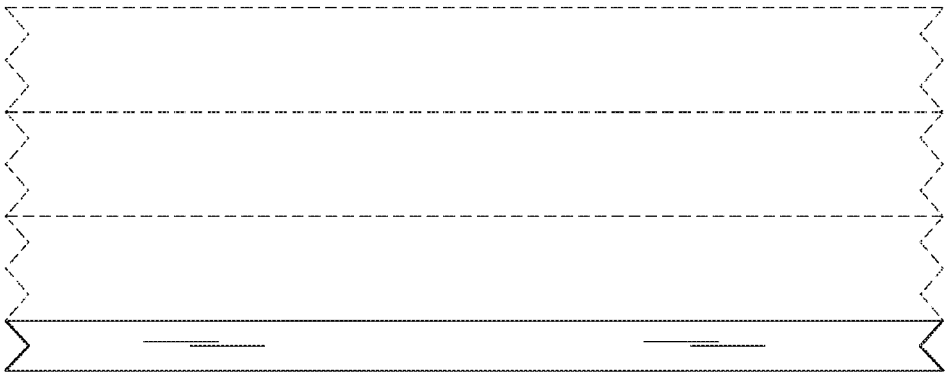
FIG. 5 is a plan view of the gusset panel of FIG. 1 folded flat.

The unitary divider 40 is shown in various folded positions in FIGS. 3, 4 and 6. In FIG. 6 the various folds sub-elements are:

panel 50, having foldable tabs or flaps 50*a*-50*b;* panel 52 with foldable tabs 52*a*-52*b* and joined to panel 50 by a plurality of zig zag fold lines 60;

panel 54 joined to panel 52 by at a fold line 54*a;* panel 56, joined to panel 54 by a plurality of zig zag folds 58.

While it is difficult to show in 2D, FIGS. 3 and 4 illustrate how the insert is placed in the box and affixed to create pockets. Panel 56 is affixed to the inner back wall 82 of box 10. Panel 56, portion 58 and Panel 54 make up the back most pocket. They are suspended by the fact that the divider is a single web so that panel 52 actually supports that rearward pocket. Panel 52 is suspended in by affixing flaps 52*a-b* to their respective inner sidewalls 18 of the box. Then foldable tabs 50*a-b* are similarly affixed to another more forwardly portion of sidewalls 18 thereby creating a second and third pocket, the middle pocket formed between panels 52 and 50 and the front pocket formed between panels 50 and the space between it and the front most wall 84 of the box.

In order that the pockets remain at the same or other predetermined depth from front to back, the position of folds 54*a*, 58 and 60 and the respective heights 52*h*, 54*h*, as measured from the center fold line of 58 and 60, to the top of the panel must be selected so that the depth the pockets is substantially the same regardless of position.

For the back pocket, this is determined by height from the fold 54*h* (assuming that panel 54 is placed so that folds 58 are coplanar). Likewise panel 50 should be affixed to inner wall 84 keeping folds 60 coplanar (i.e. the troughs are in the same plane).

If it is desired that the pockets have the same depth regardless of which pocket in the stair step, this is accomplished by adjusting the height of the bottom (58, 60) of each pocket so that it is set at a higher level for each step up. Thus, if the front of the next succeeding pocket is 2 cm higher than the next lower one, then the bottom of each pocket must be likewise 2 cm higher and its supporting panels adjusted accordingly. This provides for uniform pocket depth.

Tabs 52*a-b* and 50*a-b* are formed by cutting a blank as shown in FIG. 6. It is understood that the tabs can be added to the web separately and not part of the blank. Other means for affixing the tabs or even the panels, beside adhesive are possible. For example, the tabs and indeed all point of affixation of the web could be a releasable adhesive so that different web inserts could be used for different number of pockets while reusing the same box.

So there is disclosed, amongst other things, a stair-step file folder having a plurality of top-accessible pockets, having a box frame having a bottom, left and right sidewalls and a front and back wall, said sidewalls having a plurality of vertically oriented accordion folds to allow expansion of the frame, a unitary divider web insert configured creates a plurality of top accessible pockets of substantially equal depth having:

a. a continuous web of material folded to form a first panel attachable to said back wall, (continuous may also be segmented but joined together);

b. a second panel joined to said first panel at their bottom edges by a plurality of accordion folds having an apex and valleys on either side said apex thereby joining said first and second panels and providing expandability therebetween; (the accordion folds 58, 60 may also simply be just flat bottom segments of the web with spaced part folds);

c. a third panel joined to said second panel at their bottom edges by a plurality of accordion folds having an apex and valleys on either side said apex thereby joining said second and third panels and providing expandability therebetween;

d. a fourth panel affixable to said front wall and also joined to said third panel at their bottom edges by a plurality of accordion folds having an apex and valleys on either side said apex thereby joining said third and fourth panels and providing expandability therebetween;

e. at least one of said panels including left and right flanges attachable to said accordion folds in said sidewalls, to maintain a fixed height of said pockets.

It is understood that this 4 pocket version is only exemplary. The box file could have more or less pockets built in a similar way.

Also disclosed is a method for constructing a stair-step file folder, having a box frame with zig zag gusset sloping sidewalls and front and back inner walls, the method including any or all of the following steps in any order:

cutting and folding a blank of material to create a unitary web insert dividers, having:

a first, second, third and fourth panels joined panels, each plane joined to the next by folding accordion folds therebetween to form bottoms of pockets, cutting said blank to create lateral flange extensions on said third and fourth panels;

affixing said flange extensions to said gusset sidewalls;

affixing said first and fourth panels to said front and back inner walls;

said flange extensions and panels being affixed so that panels form a plurality of pockets of having bottoms being vertically progressively higher from front to back.

Also disclosed is a method of constructing a divider insert for a folder cutting and folding a blank of material to create a unitary web insert dividers, having:

a first, second, third and fourth panels joined panels, each plane joined to the next by folding accordion folds therebetween to form bottoms of pockets, cutting said blank to create lateral flange extensions on said third and fourth panels;

inserting the blank into the box;

affixing said flange extensions to said gusset sidewalls;

affixing said first and fourth panels to said front and back inner walls;

said flange extensions and panels being affixed so that panels form a plurality of pockets of having bottoms being vertically progressively higher from front to back.

The divider is supported on its side by an expandable gusset that surrounds them on the bottom and left and right sides of the folder. The gussets can be a web material which provides lightness and airflow, or solid.

In contrast with many known expandable folders, in which the pocket depth increases from the front to the back of the folder, the folder can have a uniform pocket depth from the front to back of the folder.

An alternate embodiment to the disclosure above, it is possible to add an additional pocket to the front of stair step folder or to any folder, or to any material or wall which has two sides and a top edge. For purposes of simplicity, the illustrated embodiment shows attachment to the stair step folder above only, but that is not to be taken as a limitation.

In FIG. 1, the front wall 70 is used as the "wall" upon which the add-on pocket is constructed and attached.

Figure 11:
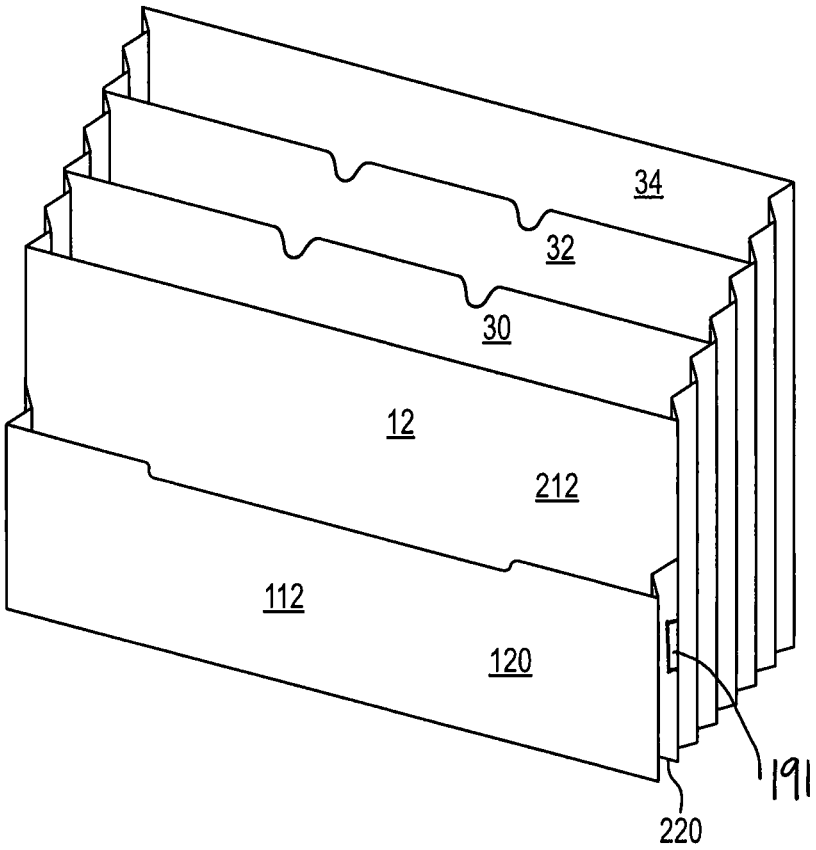
FIG. 11 is a front perspective view of an alternate embodiment with a front partial height pocket.
Figure 12:
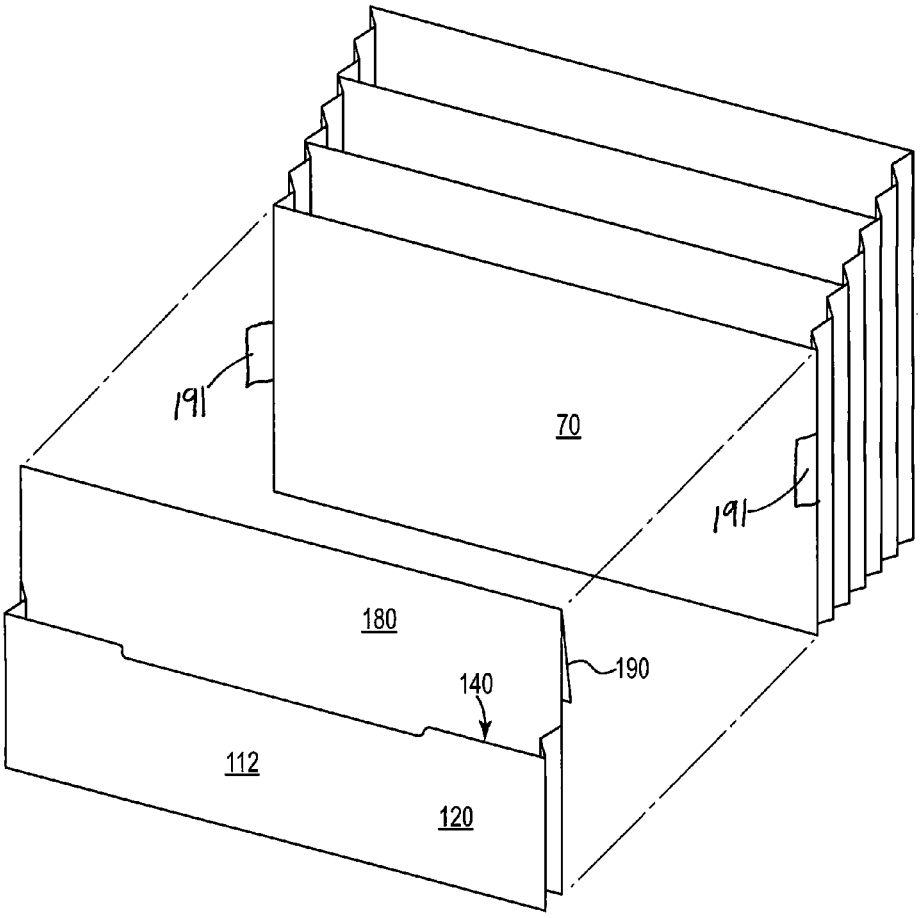
FIG. 12 is view like FIG. 11 but with the partial height pocket exploded away from the main stair-step file.

FIG. 11 illustrates the placement of the new frontal pocket 112 which has a front portion, a rear portion 212 which overlies wall 12 from the stair step folder and sidewall portions 220. As seen in FIGS. 11 and 12, retainer flaps 191 extend from said lateral edges of said folder and in this embodiment the retainer flaps are affixed to portion 180.

Figure 13:
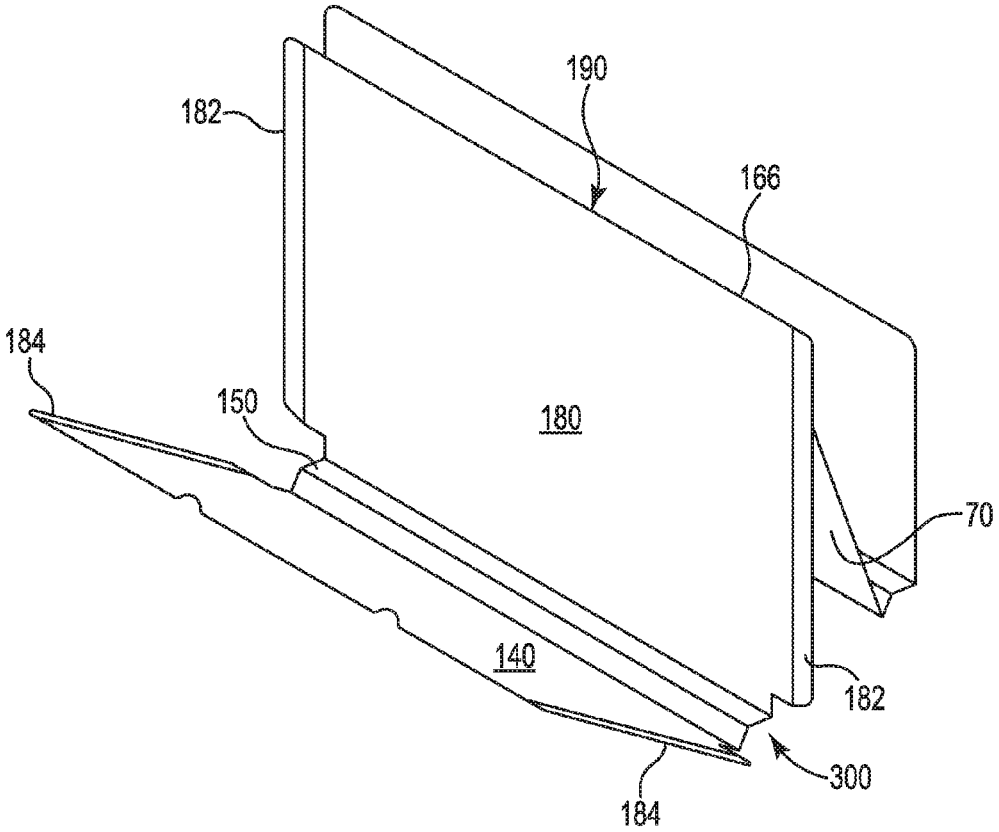
FIG. 13 is a perspective view of a cut and folded blank which forms the partial height front pocket.
Figure 14:
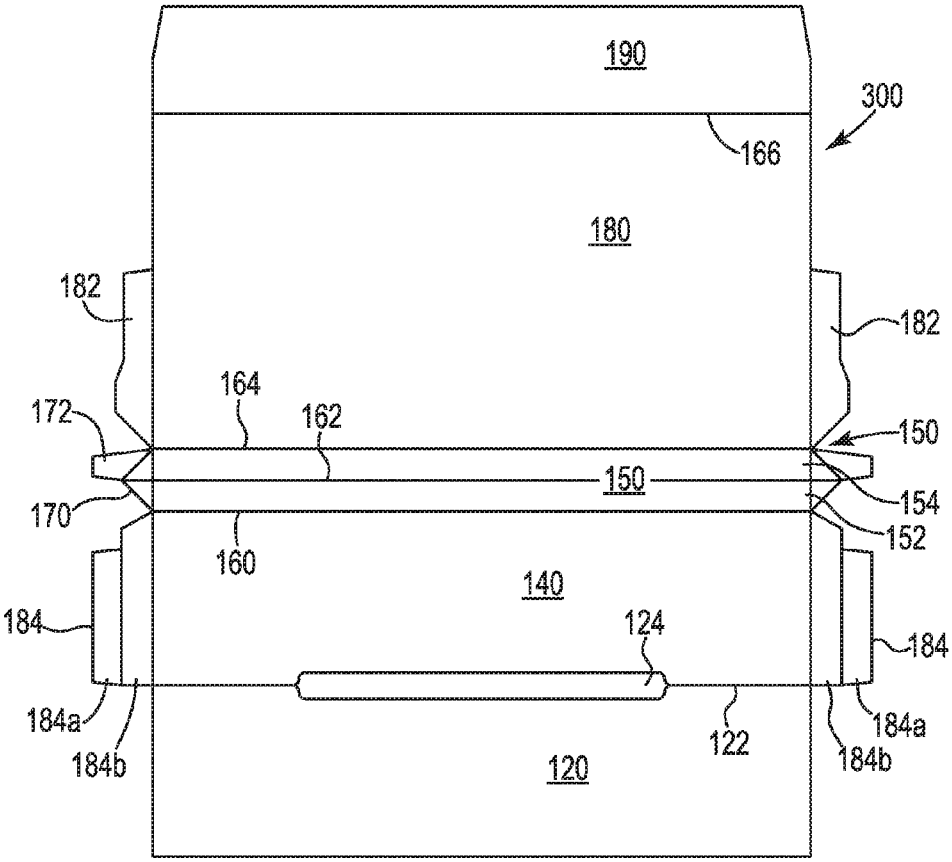
FIG. 14 is a top plan view of an unfolded blank similar to that shown in FIG. 13.
Figure 15:
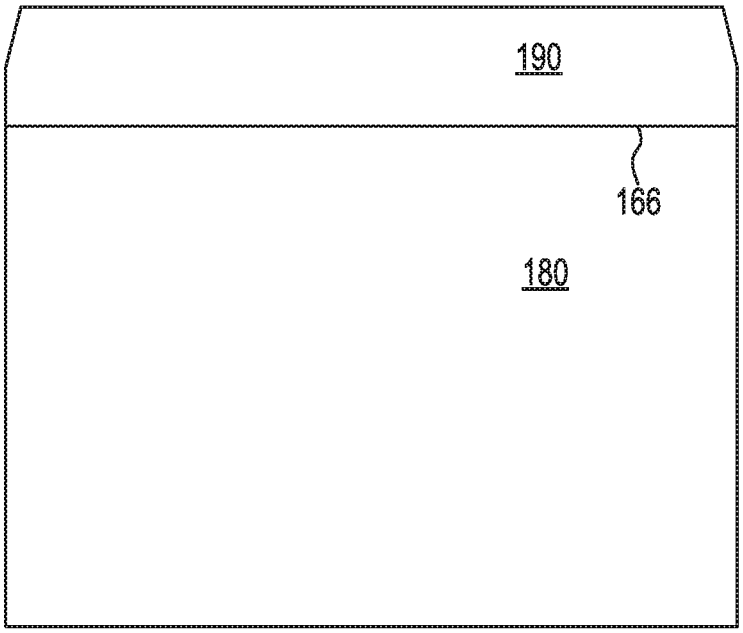
FIG. 15 is a plan view of portions 180, 190.
Figure 16:
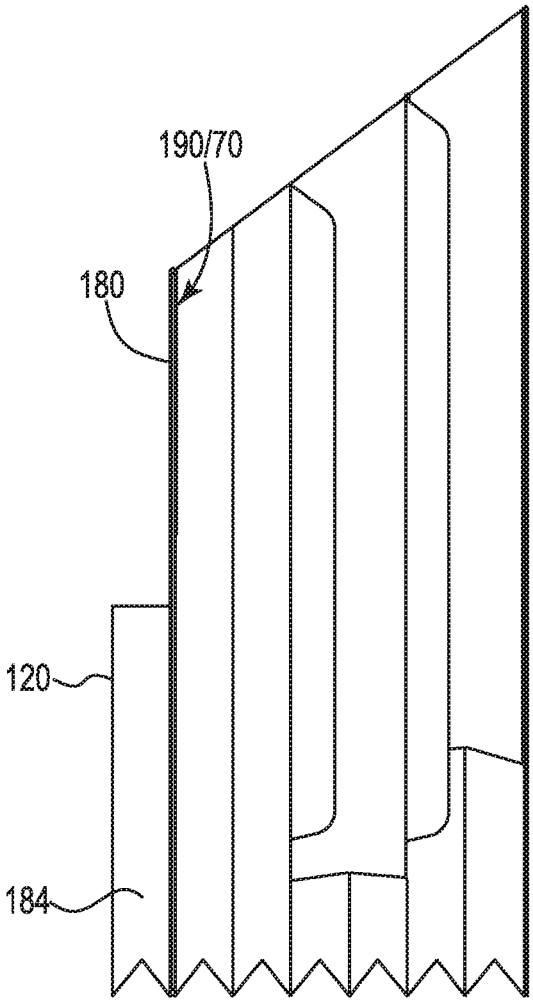
FIG. 16 is a side sectional view of an assembled folder with pocket.

FIGS. 12, 13 and 14 provide great detail of the shape and folding of the blank/web 300 which is cut to make the pocket 112.

As shown in FIG. 14, the blank 300 includes a plurality of planar portions which are scored and folded. The front portion 120 of the pocket 112 has a score line 120 and an optional aperture which may be completely omitted. This aperture provides access to the gap between portion 120 and portion 140 on the other side of score line 122. It is also noted that portion 120 can be completely omitted. Notice that the embodiments in FIGS. 13-14 differ at least because the additional elements 70 are not provided in FIG. 14. Flap 190 is either partial depth (as shown) or full depth (shown in FIG. 13), and the remaining folds and flaps shown in FIG. 13 are not used. In many cases, they are not needed.

If portion 120 is present, may be folded back behind portion 140 so that it is not at all visible or conversely folded forward so that it becomes the visible front panel. The two panels are preferably bonded to each other, at least in part.

The bottom portion 150 of the pocket may include an accordion gusset feature formed by two or more sub portions 152, 154 joined at score lines 160, 162, 164.

At the lateral ends of the bottom portion 150, the ends may be provided with closure flaps 170 which are preferably a triangular end with an apex collinear with score line 162. At least one side of the apex may also include a further land/protrusion 172 which, when bent upwardly, provides further closure for any openings which may appear at the intersection of the portions at the bottom of the pocket. This land may be any shape with provides sufficient coverage, preferably rectangular and extending from a sidewall of the apex.

Adjacent score line 164 is portion 180 which is a panel to be applied over the exterior face of panel 70. Score line 166 defines the boundary with portion 190 which is the panel that overlies a portion of front panel 70 on its interior face. Extending from lateral sides of portion 180 are closure flaps 182. These flaps correspond to closure flaps 184 on portion 140 and both are located at the same height from the bottom panel 160 so that when folded, these flaps will mate/overlap and when bonded together, form a sidewall. In the alternative, flaps 182 can be eliminated and portion 180 can be bonded directly to the corresponding panel 70 of the stair step unit. Unit 10 may also include flanges (not shown) extending from the side peripheral edges of panel 70 and be affixed to panel 180.

In the case where an accordion gusset is used in the bottom portion 160, closure flaps 180 also include an accordion portion 184*a*, 184*b* with a fold therebetween. A method of assembly of this add-on pocket preferably involves cutting a blank/web of material according to the shape needed, such as shown in FIG. 14, and scoring the material for folding.

Portion 190 is then applied and bonded (potentially with removable adhesive if the pocket is to be removeable) to the upper part of the interior face of panel 70. Fold 166 preferably sits atop the top edge of panel 70 and portion 180 overlies the exterior face of panel 70. The lateral width of portion 190 must be narrow enough to fit within the pocket, if any, bounded by panel 70, so it is preferably equal to or less than the width of panel 70.

In the preferred orientation, bottom portion 160 coincides with the bottom of panel 70 so that, in addition to the cantilever mounting of the pocket portion 190/180, its bottom is supported by whatever support (such as a table) supports panel 70. Then portion 140 is folded vertically, as are closure flaps 170/172. Retainer flaps 182 and 184*a* are then bonded together to form sidewall. If portion 120 is used in the embodiment, it is then folded over and bonded to 140 on the interior or exterior surfaces of 140. Optional aperture 124 should be open to accept pencils and the like as a sub-pocket. The shape of the cut/aperture is ornamental and arbitrary.

The description of the invention and its applications as set forth herein is illustrative and is not intended to limit the scope of the invention. Variations and modifications of the embodiments disclosed herein are possible and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. A frontal pocket on a file folder having a bottom, left and right sidewalls, front-most panel, said front-most panel having a top edge and an exterior and interior surface, and lateral sides, the frontal pocket comprising:

a planar blank having a plurality of score lines and folds thereby creating an insert pocket unit including;

a first portion extending downwardly and being affixed onto at least a portion of said interior surface of said front-most panel, and being folded over said top edge and extending downwardly and being affixed to said exterior surface, to form one sidewall of the frontal pocket; said first portion having lateral edges on the portion affixed to said exterior surface;

a second portion extending lateral and outwardly from said exterior surface a predetermined distance to form the bottom of the frontal pocket;

a third generally vertical portion extending generally upwardly from said second portion and generally parallel and spaced apart from said first portion to form a second sidewall of the frontal pocket, said third portion having lateral edges and second retainer flaps extending therefrom, said first and second retainer flaps being located to, when bent toward each other, thereby forming sidewalls of said frontal pocket; and wherein the front-most panel of the folder includes retainer flaps extending from said lateral sides, said retainer flaps of the front-most panel of the folder being affixed to said first portion.

2. The frontal pocket of claim 1 wherein said second portion includes a central longitudinal score line so that it can form an accordion fold.

3. The frontal pocket of claim 1 wherein said first portion is affixed to said exterior and interior surfaces forming a structural liner for the frontal pocket.

4. The frontal pocket of claim 1 wherein said first portion is removably affixed to said exterior and interior surfaces so that that frontal pocket is removable from the folder.

5. The frontal pocket of claim 1 wherein said third portion is less than 60% as tall as the height of the exterior surface.

6. The frontal pocket of claim 1 wherein said first portion being sized to overlay onto said interior surface and having a lateral width not greater than the lateral width of the interior surface.

7. The frontal pocket of claim 1 wherein said second portion includes lateral edges and wherein said frontal pocket includes a pair of upwardly extending closure flaps extending from said lateral flaps and configured to seal gaps between the first, second and third portions at the bottom.

8. The frontal pocket of claim 1 wherein said retainer flaps of said frontal pocket overlie one another and are bonded together to form sidewalls.

9. The frontal pocket of claim 1 wherein said first portion includes a distal piece which is folded over said surface panel and affixed to said interior surface an, thereby retaining said frontal pocket to said file folder.

10. A frontal pocket on a file folder, the file folder having a front-most panel, itself having a top edge and interior and exterior faces, the pocket comprising:

a planar blank having a plurality of score lines and folds thereby creating an insert pocket unit including;

a first portion extending downwardly and being affixed onto at least a portion of said interior face of said front-most panel and being folded over said top edge and extending downwardly and being affixed to said exterior face, to form one sidewall of the frontal pocket; said first portion having lateral edges on the portion affixed to said exterior face, and first retainer flaps extending from said lateral edges;

a second portion extending lateral and outwardly from said exterior face a predetermined distance to form the bottom of the frontal pocket;

a third generally vertical portion extending generally upward line from said second portion and generally parallel and spaced apart from said first portion to form a second sidewall of the frontal pocket, said third portion having lateral edges and second retainer flaps extending therefrom and wherein the front-most panel of the folder includes retainer flaps extending from lateral sides of said front-most panel, said retainer flaps being affixed to said first portion.

11. A method of making and retaining a front-most pocket to be affixed to a file folder, comprising:

a file folder having a front panel having a top edge and interior and exterior faces of predefined length and width and lateral sides, a pair of retainer flaps extending from said lateral sides;

a frontal pocket being formed by the steps of:

cutting a planar blank web material into a shape having first, second and third collinear segment portions with scored fold lines between the segment portions; the first segment portion being cut to be no wider than the width of the interior face and no longer than the length of the interior face;

cutting the blank have retaining flaps extending laterally from said first and second portions;

cutting the blank to have closure flaps extending from lateral edges of said first and third portions, folding the blank so that said first and third portions are generally parallel and spaced apart from each other to form a gap therebetween with said second panel spanning said gap, folding the closure flaps toward each other and to overlie each other, said closure flaps thereby forming sidewalls of the pocket adhering the first portion to said exterior face and folding a part of said first portion over said interior face and adhering it thereto, thereby creating a cantilevered attachment between the folder and the pocket;

adhering said retaining flaps of said file folder to said first portion.

* * * * *